US005155798A

United States Patent [19]

Van Denend

[11] Patent Number: 5,155,798

[45] Date of Patent: Oct. 13, 1992

[54] QUICK-RESPONSE QUARTZ TUBE INFRA-RED HEATER

[75] Inventor: Herbert Van Denend, Hawthorne, N.J.

[73] Assignee: Glenro, Inc., Paterson, N.J.

[21] Appl. No.: 312,949

[22] Filed: Feb. 21, 1989

[51] Int. Cl.[5] ..... H05B 3/40; H01C 1/026

[52] U.S. Cl. ..... 392/424; 338/234; 338/237; 338/280; 392/407; 392/417

[58] Field of Search ..... 219/354, 347, 353, 355, 219/357, 405, 409, 411, 492, 494, 497, 501, 553; 338/279, 280, 281–286, 293, 233, 236, 237, 273, 274; 34/234, 4; 313/271, 275, 315, 317

[56] References Cited

U.S. PATENT DOCUMENTS

| | | | |
|---|---|---|---|
| 2,656,449 | 10/1953 | Elgar | 219/347 |
| 2,680,183 | 6/1954 | Gomersall | 338/237 |
| 2,820,076 | 1/1958 | Lillienberg | 219/553 |
| 2,844,694 | 7/1958 | Lefebvre | 338/236 |
| 3,014,680 | 12/1961 | Steinbach | 219/347 |
| 3,348,026 | 10/1967 | Bassett, Jr. | 219/464 |
| 3,596,057 | 7/1971 | Arntz | 219/354 |
| 3,621,200 | 11/1971 | Watts, Jr. | 219/354 |
| 3,622,750 | 11/1971 | Watts, Jr. | 219/355 |
| 3,673,387 | 6/1972 | Drugmand et al. | 338/280 |
| 3,679,872 | 7/1972 | Lauck, III | 219/501 |
| 3,735,328 | 5/1973 | Yagi | 338/234 |
| 3,757,083 | 9/1973 | Dietz et al. | 219/464 |
| 3,946,353 | 3/1976 | Gallagher | 392/424 |
| 4,354,095 | 10/1982 | de Vries | 392/417 |
| 4,375,205 | 3/1983 | Green | 219/492 |
| 4,494,316 | 1/1985 | Stephansen et al. | 34/4 |
| 4,531,047 | 7/1985 | Canfield et al. | 219/347 |
| 4,551,614 | 11/1985 | Johnson | 338/280 |
| 4,756,091 | 7/1988 | Van Denend | 219/411 |

*Primary Examiner*—Geoffrey S. Evans
*Attorney, Agent, or Firm*—Siegmar Silber

[57] ABSTRACT

An infra-red heater for a hybrid oven drying a web with an elongate foil having transverse corrugations heating element within a quartz tube. A thermocouple sensor is used to provide a control signal to a controller to regulate the infra-red output.

40 Claims, 2 Drawing Sheets

QUICK-RESPONSE QUARTZ TUBE INFRA-RED HEATER

FIELD OF THE INVENTION

The invention relates generally to infra-red heaters, particularly to heaters having a low mass and a large radiating surface area, which operate at high temperatures in a range centering around 1500° F. such heaters are quick response heaters in the sense that they heat up to and cool down from their operating temperatures in times on the order of from 5 to 6 seconds.

DISCLOSURE INFORMATION STATEMENT

In the past, infra-red heating devices have been used for process drying and specifically for drying of coatings applied to continuous webs. Although many heater configurations have been tested, no one configuration has exhibited the infra-red characteristics and the quick response which, when continuous web travel stops unexpectedly, the heat is removed almost instantaneously. Such responsiveness would avoid damage by excess infra-red radiation. It has also been found that various constructs absorb radiated thermal energy and form a residual source of heat long after the element has been turned off, e.g., a toaster after the toast pops up.

Recently, in industrial applications, attention has been focused on hybrid systems in which two or more thermal energy sources have been employed in a single device. An example of a hybrid system is described in the Applicant's recent patent, U.S. Pat. No. 4,756,091, entitled Hybrid High Velocity Heated Air/Infra-Red Drying Oven, which describes an oven utilizing heated air at high velocity and infra-red heaters. With these hybrid devices, the problems of quick response and temperature maintenance are exacerbated by the air currents reflected from the workpiece or web and equipment surfaces.

The Hager '850 patent describes a corrugated heating element which because of the large element surface was in the late 1960's, considered to be quick response element; but is not considered to be so in terms of today's technology.

As shown, by way of example, in U.S. Pat. No. 2,682,596, Cox et al, metallic foil heaters on a backing are well known. Such laminated heaters, however, cannot function at the relatively high temperatures contemplated for use by the heaters of the present invention. High temperature heaters, particularly those having a relatively broad surface, as compared with the surface of a resistant wire, are normally made by imbedding wire heating elements or rod heating elements in a thick plate in order to achieve the requisite temperature in the thick plate. Other resistant heaters designed to function at high temperatures are made of relatively thick bars or bands which glow when electricity is passed through the resistance heating element. All such heaters have large thermal inertia in that they cool down slowly when turned off, and heat up slowly when turned on. When such heaters are used to dry coatings on continuous webs of material difficulty is encountered when the continuous web is stopped. Stoppage of the coated web proximal to such heaters causes the web to be overheated, scorched, otherwise damaged or destroyed. These high-temperature, large-mass heaters cannot upon removal of power cool sufficiently fast enough to prevent damage to the coated web being dried, especially when the web is brought to a sudden stop adjacent the heater.

In Hager, U.S. Pat. No. 3,525,850 a metallic foil heater similar to Cox, supra, is described wherein the corrugated foil heating element is mounted on a thermally insulating backing. The heating element is attached to the backing by wire on metal mounts which extend through the insulating backing.

Although foil heaters as in Cox '596 and Hager'850 have been used for many types of drying applications, there remain other applications wherein the heater must be both very responsive to power being applied or removed and remain unaffected by surrounding air currents. These applications include the mix or hybrid of thermal energies in drying ovens which has proved interesting from several viewpoints including: (1) the rate and depth of drying; (2) the control of the drying process; (3) the uniformity of the dried coating; and, (4) the total energy used for the application, as a result there is a renewed interest in solving the heater responsiveness problem.

SUMMARY OF THE INVENTION

The problems mentioned above are solved by a heater with a foil or ribbon-like electric heating element housed within a quartz envelope or tube. To maintain the substantially planar radiating face of the heating element in a flat condition throughout the operating temperature range, the heating element is held under longitudinal tension between the endcaps. In the case of continuous web applications, the radiating face of the heating element is aligned in an orientation substantially parallel to the surface of the continuous web being dried. Generally, but especially in the case of hybrid oven applications, the quartz envelope protects the heating element from convective cooling. With the low-mass of the foil heating element and the low thermal absorptivity of the surrounding components, the electric infra-red heater of the present invention, upon activation, approaches within 200° F. of the normal maximum element temperature within a few seconds, and conversely, upon removal of power, the infra-red heater falls from the normal element temperature to below 600° F. within a few seconds. Further, the infra-red heater of the present invention is readily adapated to control instrumentation by way of a control signal producing sensor which is inserted into the quartz tube adjacent the foil heating element and of a controller which is interactive with the control signal to maintain a predetermined temperature in response thereto.

DESCRIPTION OF THE PREFERRED EMBODIMENTS

Figure 1:
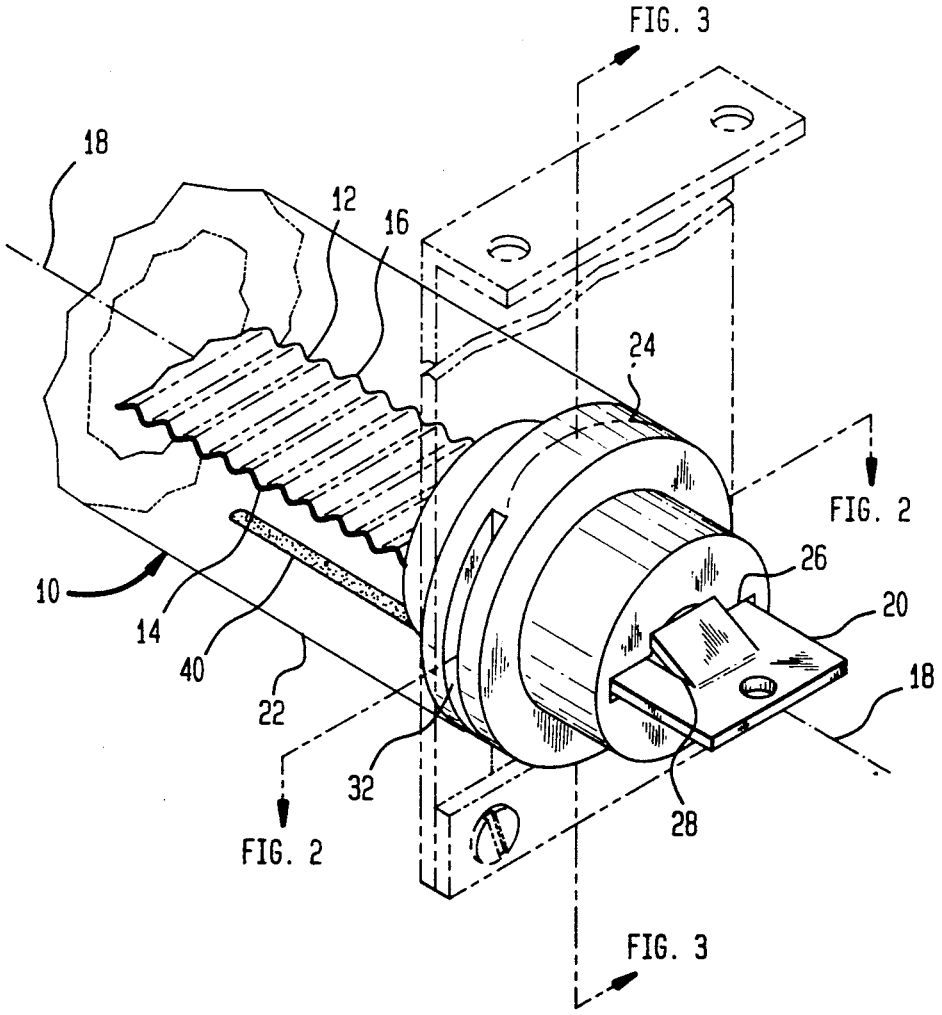
FIG. 1 is a perspective view of the quartz quick response infra-red partially broken away so as to show the heating element thereof.
Figure 2:
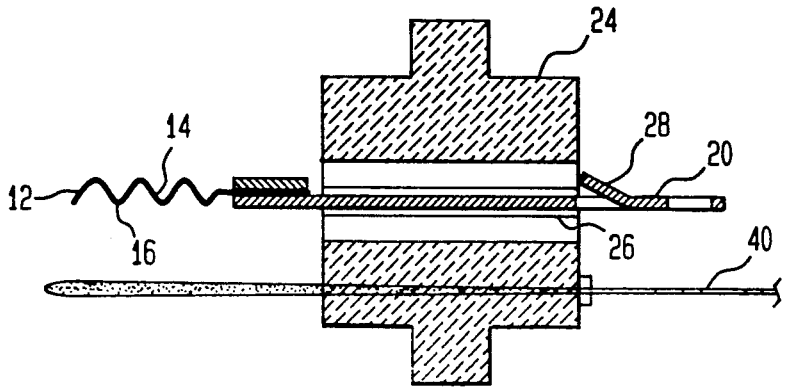
FIG. 2 is a cross sectional view through lines 2—2 showing the alignment of the corrugated elongated strip.
Figure 3:
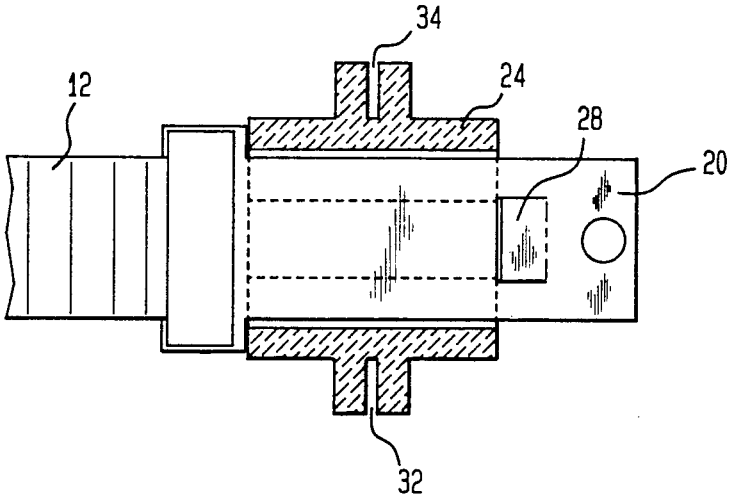
FIG. 3 is a cross sectional view of the endcap assembly with the heating element attached thereto, said cross sectional view is taken on a plane normal to the central plane of the heating element.
Figure 4:
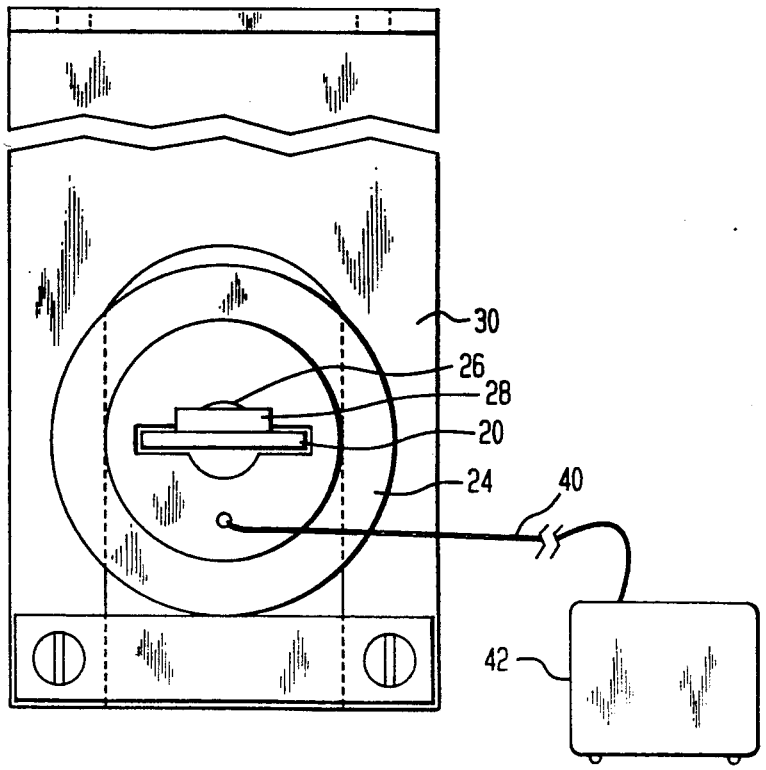
FIG. 4 is another cross sectional view of the endcap assembly taken along a plane normal to that of FIG. 3.

Referring to FIG. 1 through 4, a quartz tube, infra-red heater is shown, and is referred to generally be reference designator 10. The infra-red heater, 10 is constructed to include a ribbon-like electric heating element 12 which, in turn, is constructed from an elongated strip 14 of corrugated material, such as a stainless steel foil of an austenitic-type alloy (commonly available under the trademarks, "Hastelloy", "Inconel" and "Waspalloy"). The corrugations 16, are formed substantially transverse to the longitudinal axis 18 of the strip 14. The heating element 12 is further constructed with platelets or terminations 20 attached at each end of the elongated strip 14. Both the elongated strip 14 and the platelets 20 are known in the art insofar as the corresponding items shown in the Hager patent, supra, are used therein for metallic foil heaters mounted on a backing. The heating element 12 is mounted in a quartz tube 22 under slight tension so that the general shape and position of the element is maintained under throughout the operating temperature range. The tension is obtained by predetermining the length of elongated strip 14 and by stretching the heating element 12 between a pair of endcap assemblies 24. In the best mode of practicing the present invention, the endcap assemblies 24 are constructed with an aperture 26 therethrough which accommodate the platelet 20 and a locking tab 28. The locking tab 28 is arranged so that, when a foil heating element 12 is mounted between a pair of endcaps 24 (with the locking tabs 28 locked in place), the element 12 is tensioned to fully face the workpiece upon which the radiation therefrom impinges. A standoff bracket 30 forming a yoke-like arrangement with endcap 24 engages keyways 32 and 34 and thereby positively retains the element 12 as described hereinbefore. The endcap assembly 24 is completed by a readily demountable holddown tab 36 secured to bracket 30 by mounting hardware 38. In the best mode of practicing the invention, the heating element is constructed to include a thermal sensor device for providing a control signal relative to the element temperature which sensor device is a thermocouple 40 with one end thereof supported by the endcap assembly 24. Interconnected with the thermocouple 40 is an infra-red controller 42 constructed to receive a feedback control signal that is proportional to the temperature of the heating element. The infra-red controller 42 as in Applicant's U.S. Pat. No. 4,756,091, in turn, is responsive to the feedback control signal and is able to maintain the infra-red radiation at the desired controlled levels.

In operating the utilization of the infra-red heater is first described. Upon application of power the infra-read heating element 12 substantially instantaneously provides infra-red radiation. The quick response is best shown in the tabulation included hereinbelow, Table I, wherein the temperature response versus time is indicated. The same Table also shows response time for a Hager-type heater and for a conventional quartz tube coil type heater. In a similar manner data for cool down is also provided on the Table. From the tabulation it is shown that with a heater having normal maximum element temperature of approximately 1500° F. at 220 volts the element attains 1300° F. within approximately 5 seconds. During operation as the heating element is under longitudinal tension the radiating face thereof remains flat and is positioned in such alignment. In applications of continuous web drying systems this provides for parallelism between the radiating face and the surface of the continuous web. In applications wherein the infra-red heater is used as part of a hybrid drying oven, that is in cases in which both high velocity heated air and electric infra-red heaters are used as the thermal energy sources for drying. The quartz tube structure of this invention prevents any undue convective cooling. Additionally the quartz tube while protecting the heating element is transparent to infra-red radiation and transmits infra-red radiation up to approximately 4 microns.

In operation where feedback control of heater applications is desired, such control is facilitated by the above described structure. The thermal sensor in the best mode of practicing the invention is a thermal couple with one end mounted in the endcap, provides a control signal that is proportional to the temperature of the heating element. When the resultant with the presently determined controlled program. By following the operating program the infra-red controller can provide appropriate voltage so that is presently determined infra-red output is reached. Quite commonly the infra-red controller provides supply voltages from 9 to 100% of line voltage and further provides normal maximum element temperature at approximately 80% of line voltage. Thus, when the infra-red output is insufficient at the 80% of line voltage level then the controller can require from the system additional voltage output and maintain the infra-red radiation at the desired controlled levels.

Although the best mode of the invention has been described herein in some detail, it has not been possible to include each and every variation. Those skilled in the art of infra-red heaters will be able to make slight variations in the mechanical arrangement suggested hereby without departing from the spirit of the invention and still be within the scope of the claims appended hereto.

What is claimed is:

1. An improved low-mass, infra-red heater comprising, in combination:

an electric, ribbon-shaped, electric heating element with transverse corrugations enabling the heating element, when held under longitudinal tension, to maintain a substantially planar radiating face throughout the operating temperature range;

a quartz tube housing said heating element therewithin without a thermally insulative backing and for protecting said heating element from convective cooling, said envelope means having two ends and being substantially transparent to infra-red radiation;

a pair of endcaps, one mounted at each end of said quartz envelope means, each for receiving a terminal portion of the heating element; and, attachment means for attaching each terminal portion of said heating element to a respective one of said endcaps and for connecting said element to a source of voltage;

whereby said infra-red heater is operable to provide, upon activation, immediate heating, and, upon removal of power, substantially instantaneous cool down.

2. An improved low-mass, infra-red heater as described in claim 1, wherein said heating element is of a stainless steel foil.

3. An improved low-mass, infra-red heater as described in claim 2, wherein said heating element is adapted to be normally operable within the 100- to 240-volt range and when operating at a predetermined maximum voltage, have a maximum element temperature of from 1200° F. to 1800° F.

4. An improved low-mass, infra-red heater as described in claim 3, wherein said heating element is of a stainless steel foil having a thickness of approximately 3-mils and has a normal maximum element temperature of 1400° F.

5. An improved low-mass, infra-red heater as described in claim 4, wherein said heating element is adapted, upon activation, to approach within 100° F. of normal maximum element temperature within approximately 5 seconds.

6. An improved low-mass, infra-red heater as described in claim 4, wherein said heating element is adapted, upon removal of power, to fall from normal maximum element temperature to below 600° F. within approximately 5 seconds.

7. An improved low-mass, infra-red heater as described in claim 3 wherein said heating element is of a stainless steel foil having a thickness of 3-mils.

8. An improved low-mass, infra-red heater as described in claim 7, wherein said heating element is adapted to be normally operable within the 100- to 240-volt range and, when operating at 220 volts, has a normal maximum element temperature of between 1500° and 1600° F.

9. An improved low-mass, infra-red heater as described in claim 8, wherein said heating element is adapted, upon activation to attain approximately 1300° F. within approximately 5 seconds.

10. An improved low-mass, infra-red heater as described in claim 8, wherein said heating element is adapted, upon removal of power to fall from approximately 1400° F. to below 600° F. within approximately 5 seconds.

11. An improved low-mass, infra-red heater as described in claim 1, further comprising:

a base;

standoff mounting means for mounting said quartz tube to said base; and, alignment means for maintaining said radiating face substantially parallel to said base.

12. An improved low-mass, infra-red heater as described in claim 1, wherein said quartz tube transmits infra-red radiation up to a wavelength of approximately 4 microns.

13. An improved low-mass, infra-red nearer as described in claim 1, wherein said quartz tube is elliptical in cross-section.

14. An improved low-mass, infra-red heater as described in claim 13, wherein said quartz tube is circular in cross section.

15. An improved low-mass, infra-red heater as described in claim 1, further comprising a thermal sensor means for providing a control signal relative to the element temperature.

16. An improved low-mass, infra-red heater as described in claim 15 wherein said thermal sensor means is a thermocouple supported at one end thereof by the endcap.

17. An improved low-mass, infra-red heater as described in claim 1 wherein said endcap is a ceramic endcap.

18. An improved low-mass, infra-red heater as described in claim 17 wherein said endcap is an insulative ceramic endcap.

19. An improved low-mass infra-red heater as described in claim 1 wherein said attaching means is a highly conductive platelet.

20. An improved electric, infra-red heater for continuous web drying systems, said infra-red heater being highly responsive to system interrupt control signals comprising, in combination:

an elongate foil heating element with transverse corrugations enabling the heating element to maintain a substantially planar radiating face throughout the operating temperature range;

a quartz tube for enveloping said heating element therewithin without a thermally insulative backing and for protecting said heating element from convective cooling, said quartz tube having two ends and being substantially transparent to infra-red radiation;

a pair of insulative endcaps, one at each end of said quartz tube for holding an end portion of said heating element; and platelet means for attaching each said end portion of said heating element in cooperative functional relationship with said insulative endcap, said platelet means further providing electrical feed through said insulative endcap to said heating element;

whereby in response to a system interrupt control signal, infra-red heat production ceases substantially instantaneously and thereby minimizes damage to the continuous web.

21. An improved electric, infra-red heater as described in claim 20, said heating element is adapted to be normally operable within the 100- to 240-volt range and, when operating at a predetermined maximum voltage, have a maximum element temperature of from 1200° F. to 1800° F.; wherein said heating element is adapted, upon activation, to approach within 100° F. of normal maximum element temperature within approximately 5 seconds; and wherein said heating element is adapted, upon removal of power to fall from normal maximum element temperature to below 600° F. within approximately 5 seconds.

22. An improved electric, infra-red heater as described in claim 21, wherein said heating element is of a stainless steel foil having a thickness of approximately 3-mils and has a normal maximum element temperature of 1400° F.

23. An improved electric, infra-red heater as described in claim 22 wherein said heating element is adapted, upon activation, to approach within 100° F. of normal maximum element temperature within approximately 5 seconds; and wherein said heating element is adapted, upon removal of power to fall from normal maximum element temperature to below 600° F. within approximately 5 seconds.

24. An improved infra-red heater as described in claim 21, wherein said heating element is a stainless steel foil having a thickness of 3-mils.

25. An improved electric, infra-red heater as described in claim 24, wherein wherein said heating element is adapted to be normally operable within the 100- to 240-volt range and, when operating at 220 volts, having a normal maximum element temperature of approximately 1400° F.; wherein said heating element is adapted, upon activation to attain approximately 1300° F. within approximately 5 seconds; and wherein said heating element is adapted, upon removal of power, to fall from approximately 1400° F. to below 600° F. within approximately 5 seconds.

26. An improved electric infra-red heater as described in claim 20, further comprising a thermocouple supported at one end thereof by said endcap providing a control signal relative to the element temperature.

27. An improved electric, infra-red heater as described in claim 20 further comprising:

alignment means for maintaining said radiating face substantially parallel to the surface plane of the continuous web being dried.

28. An improved electric, infra-read heater as described in claim 20 wherein said insulative endcap is an insulative ceramic endcap.

29. An improved electric, infra-red heater for a hybrid drying oven, said infra-red heater comprising, in combination:

an elongate foil heating element with transverse corrugations enabling the heating element, when held under longitudinal tension, to maintain a substantially planar radiating face throughout the operating temperature range;

a quartz tube for enveloping said heating element therewithin without a thermally insulative backing and for protecting said heating element from convective cooling, said quartz tube having two ends and being substantially transparent to infra-red radiation;

thermal sensor means for providing a control signal relative to the element temperature; and, infra-red controller means for increasing and decreasing power to said heating element, said infra-red controller means capable of providing voltages at levels substantially higher than the upper limit of the rated voltage range for said heating element;

connection means for interconnecting said thermal sensor means and infra-red controller means, said connection means connecting said thermal sensor to provide said signal therefrom to said infra-red controller means;

whereby, upon said thermal sensor means sensing that said heating element is operating at less than the predetermined temperature and is providing less than required infra-red output, the infra-red controller means provides higher voltages until the predetermined infra-red output is reached.

30. An infra-red heater for a hybrid oven described in claim 29 wherein said infra-red controller means provides supply voltages from 9 to 100% of available line voltage; and further wherein said infra-red element is selected for normal maximum operating at approximately 80% of line voltage and for radiating infra-red at a predetermined element temperature.

31. An infra-red heater for a hybrid oven as described in claim 30 wherein said infra-red controller means is a controller providing supply voltages from 0 to 240 volts, and said infra-red element normally operable within the 100- to 240-volt range having a normal maximum element temperature of approximately 1600° F. when operating at 240 volts.

32. An infra-red heater for a hybrid oven as described in claim 29 further comprising:

a pair of insulative endcaps, one at each end of said quartz tube for holding an end portion of said heating element;

whereby said infra-red heater is operable to provide, upon activation, immediate heating and, upon removal of power, substantially instantaneous cool down.

33. An infra-red heater for a hybrid oven as described in claim 32, further comprising a base;

standoff mounting means for mounting said quartz tube to said base; and, alignment means for maintaining said radiating face substantially parallel to said base.

34. An infra-red heater for a hybrid oven as described claim 32, being for drying of a coating on a continuous web said heater further comprising alignment means for maintaining said radiating face substantially parallel to the surface plane of the continuous being dried.

35. An infra-red heater for a hybrid oven as described in claim 34, wherein said heating element is of a stainless steel foil having a thickness of approximately 3-mils and has a normal maximum element temperature of 1400° F.

36. An infra-red heater for a hybrid oven as described in claim 35, wherein said heating element is adapted to be normally operable within the 100- to 240-volt range and when operating at a predetermined maximum voltage, have a maximum element temperature of from 1200° F. to 1800° F.

37. An infra-red heter for a hybrid oven as described in claim 34, wherein said heating element is of a stainless steel foil having a thickness of 3-mils.

38. An infra-red heater for a hybrid oven as described in claim 37, wherein said heating element is adapted, upon activation to approach within 100° F. of normal maximum element temperature within approximately 5 seconds; and wherein said heating element is adapted, upon removal of power to fall from normal maximum element temperature to below 600° F. within approximately 5 seconds.

39. An infra-red heater for a hybrid oven as described in claim 34, wherein wherein said heating element is adapted to be normally operable within the 100- to 240-volt range and when operating at 220 volts having a normal maximum element temperature of approximately 1400° F.; wherein said heating element is adapted, upon activation to attain approximately 1300° F. within approximately 5 seconds; and wherein said heating element is adapted, upon removal of power to fall from approximately 1400° F. to below 600° F. within approximately 5 seconds.

40. An infra-red heater for a hybrid oven as described in claim 32, wherein said thermal sensor means is a thermocouple supported at one end thereof by the insulative endcap.

* * * * *